US007013107B2

(12) United States Patent
Russel et al.

(10) Patent No.: US 7,013,107 B2
(45) Date of Patent: Mar. 14, 2006

(54) SYSTEMS AND METHODS FOR CONTINUOUS MOTION REGISTRATION DISTRIBUTION WITH ANTI-BACKLASH AND EDGE SMOOTHING

(75) Inventors: Steven M. Russel, Pittsford, NY (US); Dewey H. Hauman, Penn Yan, NY (US); Julie M. Hanfland, Rochester, NY (US); Richard C. Schenk, Webster, NY (US)

(73) Assignee: Xerox Corporation, Stamford, CT (US)

( * ) Notice: Subject to any disclaimer, the term of this patent is extended or adjusted under 35 U.S.C. 154(b) by 184 days.

(21) Appl. No.: 10/707,579

(22) Filed: Dec. 22, 2003

(65) Prior Publication Data

US 2005/0135846 A1 Jun. 23, 2005

(51) Int. Cl.
*G03G 15/20* (2006.01)

(52) U.S. Cl. ..... 399/328; 399/332

(58) Field of Classification Search ..... 399/328, 399/330–332; 219/216; 432/60
See application file for complete search history.

(56) References Cited

U.S. PATENT DOCUMENTS 4,789,877 A * 12/1988 Izaki ..... 219/216
4,942,434 A * 7/1990 Nakai et al. ..... 399/331
5,323,216 A 6/1994 Mahoney
6,463,252 B1 * 10/2002 Omoto et al. ..... 399/330

* cited by examiner

*Primary Examiner*—William J. Royer
(74) *Attorney, Agent, or Firm*—Oliff & Berridge, PLC

(57) ABSTRACT

A reprographic marking device has two rolls, e.g., a pressure roll and a fuser roll, forming a nip. A drive motor moves the rolls in a continuous back and forth lateral motion to change the position of the rolls relative to a paper sheet passing through the nip.

19 Claims, 12 Drawing Sheets

SYSTEMS AND METHODS FOR CONTINUOUS MOTION REGISTRATION DISTRIBUTION WITH ANTI-BACKLASH AND EDGE SMOOTHING

BACKGROUND

The invention relates generally to a reprographic fusing device for fixing a toner image to a substrate. More specifically, the invention relates to a fusing device that is continuously movable relative to the print medium during printing.

In electrostatic printing, a dry marking material, such as toner, is fused to a substrate, such as a paper sheet. Fusing occurs when the substrate is subjected to pressure and/or heat to permanently affix the marking material to the substrate. Most common electrostatic printers use a fuser roll and a pressure roll that form a nip for the substrate to pass through. In many such printers, a variety of different size sheets may be passed through the nip of the rollers.

All conformable rolls suffer from surface wear, especially where the edges of the sheets contact the roll surface. FIG. 1 shows how the edges and body of 11" and 14" sheets of paper are distributed along the surface of a fuser roll in the axial direction in printers without a registration distribution system. In such printers, the sheet edges produce a stress concentration as they pass through the fuser nip under pressure, causing the thin surface coating on the roll, as well as the elastomeric layer under the surface, to degrade. The degradation of the roll is often manifested as a narrow area of lower gloss from a lead edge to a trail edge across the print fused to the substrate. In the context of mixed paper sizes, a 14" print often shows a differential gloss streak 11" in from the outboard (registered) edge. Such artifacts become visible to the customer after only a few thousand prints have passed through the fuser, far short of the target life of the roll.

One proposed solution to such problems is to change fuser rolls to accommodate different size papers. However, this method is not always practical or in keeping with existing program goals. For example, if only one paper size is run for a given roll set, the edge wear exists, but is outside the normal visible area of the print and goes unnoticed.

Another proposed solution is provided in U.S. Pat. No. 5,323,216 which discloses a lateral moving fuser station. The lateral moving fusing station is an intelligent system in which detection of incoming paper size is utilized to reposition the roll in an axial direction based on usage demographics, such that the location of edge wear is spread over a larger area.

The station includes a pressure roller and a heated fusing roller that are in pressure contact with each other to form a fusing nip. The fusing station is mounted on a base plate and is moved by a stepping-type drive motor controlled by a control and logic circuit. The control and logic circuit either activates the stepping motor prior to the start of a copy cycle for a set time period to move the fuser station laterally a pre-set distance, or activates the motor after a pre-set volume of copies have been fused. This way, if most of the paper run is 11 inches wide, a discrete or specific location within the 3 inches of roll from the 11 inch position to the 14 inch position can be made available for edge redistribution. However, by restricting lateral movement of the fusing station as described, productivity may be slowed due to the necessity to move to the fusing station during a print operation, such as when the pre-set volume of copies have been fused. Furthermore, banding may also result from the use of such discrete stepping systems.

These and other known methods have drawbacks which severely limit any performance benefits from existing registration distribution systems. For example, by moving the fusing station only between copy runs or interframes a pre-set distance, the fuser roller will suffer unnecessary wear at the point where the edges of the sheets contact the roll surface. The wear will continue to manifest itself as a narrow area of lower gloss from lead to trail edge across the print.

SUMMARY

To address the problem of edge wear on fuser rolls, a registration distribution system is disclosed in which no prior knowledge of paper size is required and the axial motion of the rolls is continuous. By continuously moving the fuser assembly, differential gloss artifacts due to repetitive stress concentrations are spread out over a greater area thereby maximizing roll life with no dependence on paper size. Furthermore, continuously moving the fuser assembly eliminates the potential for banding caused by a stepping-type registration distribution system.

In an exemplary embodiment of the invention, the length of a fuser roll may be increased to allow even the largest paper size to have full travel across the roll area. In another exemplary embodiment, edge effects due to lead screw backlash are reduced by a mechanical system, such as a spring. In yet another exemplary embodiment of the invention, an edge smoothing algorithm is also employed in the invention to further reduce the perception of edge wear.

Although the following exemplary embodiments are described with reference to conformable fuser rolls, the systems and methods described herein pertain to any rolls having a conformable surface.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods according to this invention will be described in detail, with reference to the following figures, wherein.

DETAILED DESCRIPTION OF EMBODIMENTS

Figure 1:
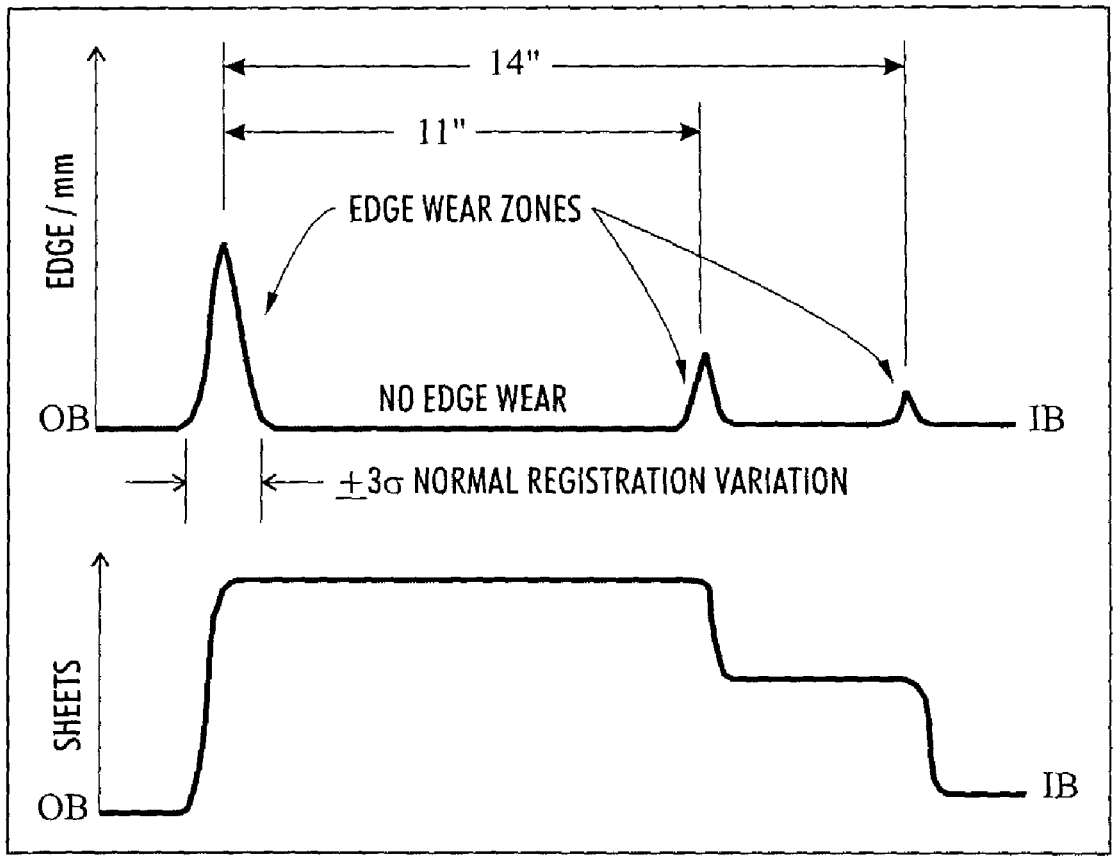
FIG. 1 RELATED ART
FIG. 1 shows conformable fuser roll wear distribution along the roll surface in the axial direction in printers without a registration distribution system.
Figure 2:
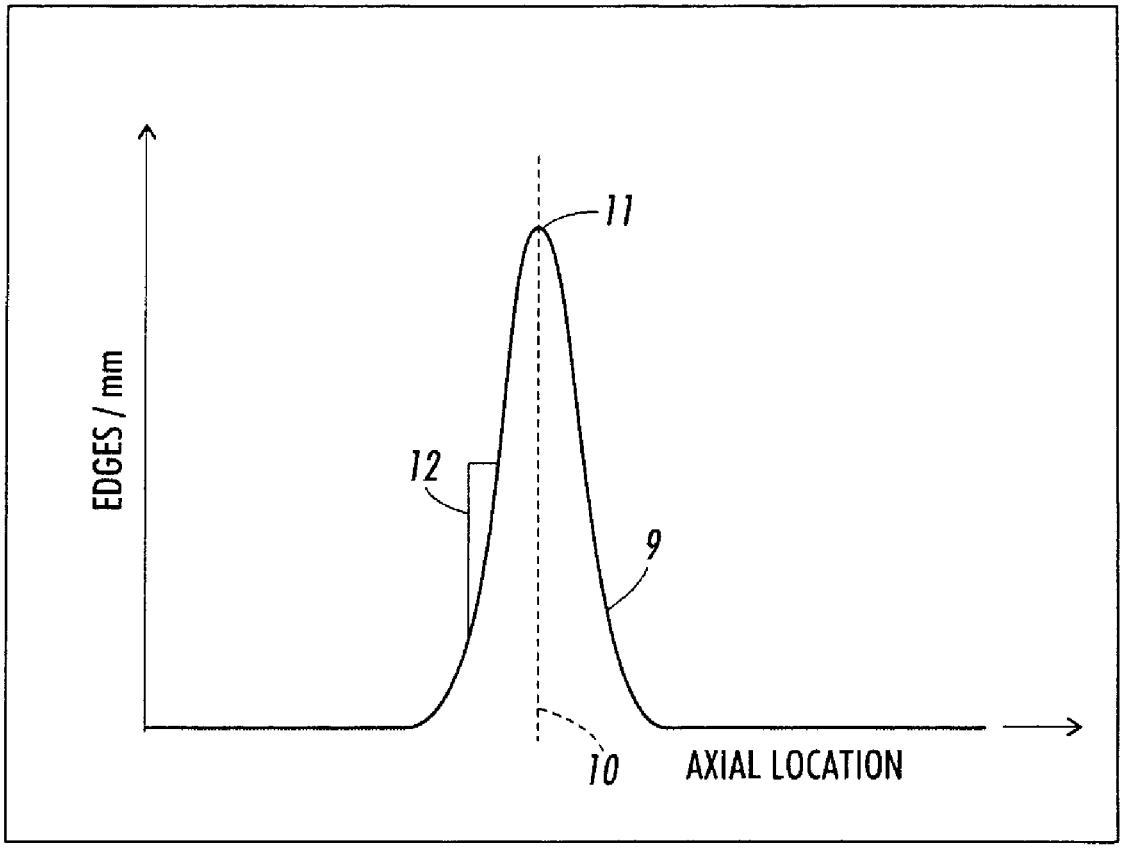
FIG. 2 is a graph showing conformable fuser roll edge wear in a print system without a registration distribution system.

FIG. 2 is a graph of experimental results showing the relationship between the total number of sheets processed and measured differential gloss levels representing conformable fuser roll wear in a printing system without a registration distribution system. The graph represents onset of edge wear in a printing system without a registration distribution system and the determination of perceivable (differential) gloss. As sheets pass through a nip formed between a conformable fuser roll surface and a non-conformable pressure roll surface near the registration location 10, the sheets are normally distributed according to the accuracy of the paper registration system upstream of the fuser.

Over a period of time, the distribution of conformable fuser roll wear grows to look like the diagram in FIG. 2, wherein the area under the curve 9 represents the total number of sheets passed through the nip. An example of a way in which edge wear is perceived is at the peak 11 when a certain differential gloss level has been reached. At the peak 11, the results of edge wear are manifested as differential gloss and will be easily seen by an observer. Worn areas will have relatively lower gloss than will un-worn areas.

It was also determined that there is a direct correlation between peak edges per mm and differential gloss, as measured in Gardner Gloss Units (ggu) by a gloss meter. For example, below a certain threshold level (about 5 ggu), differential gloss is not readily perceived by the un-aided eye. Thus, in an exemplary embodiment of the invention, a design specification of about 5.0 ggu was determined to be an acceptable target range of differential gloss on fused sheets.

Differential gloss may be perceived by an observer at the transition point between worn and non-worn areas of the roll. For example, the slope 12 of the distribution shown in FIG. 2 was determined to be important because a sharp transition, as represented by the slope 12, from worn and non-worn areas is perceived more readily than smooth transitions.

Figure 3:
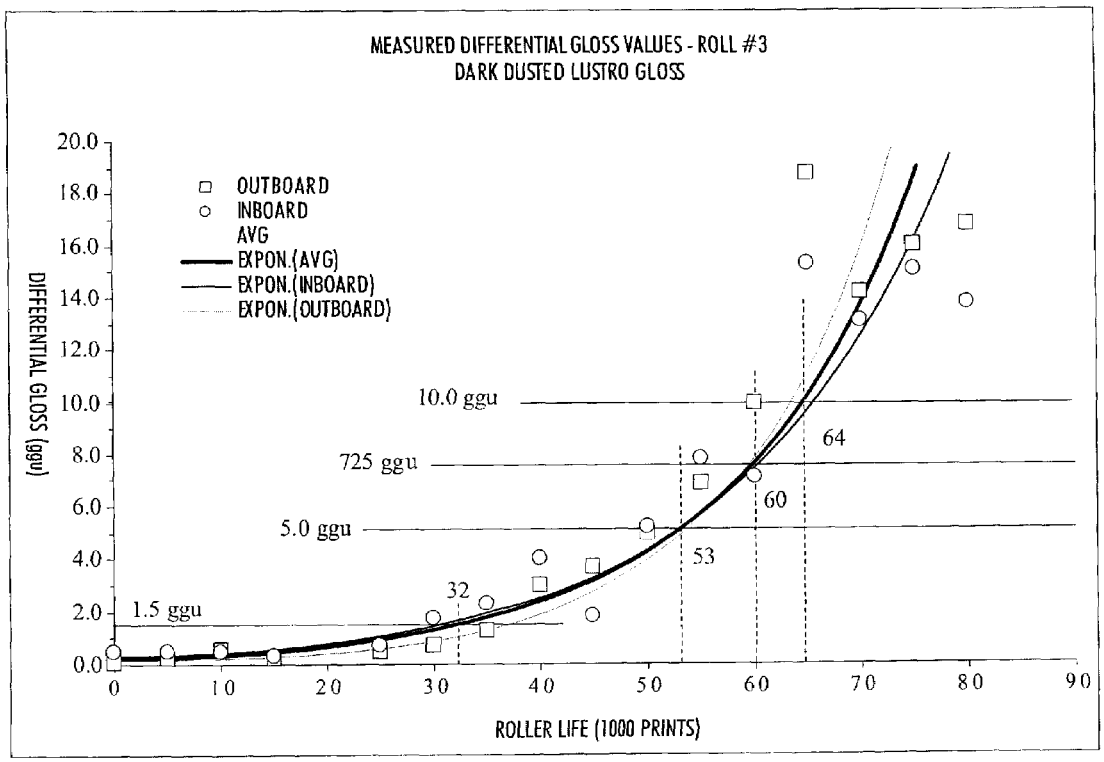
FIG. 3 is a graph showing the relationship between total number of sheets processed and measured conformable fuser roll differential gloss levels.

FIG. 3 is a graph showing the relationship between total number of sheets processed and measured differential gloss levels. The results shown in FIG. 3 were derived using a registration distribution system incorporating 4 mm of roll length to concentrate the effects of the registration distribution system over a known usable surface area to limit total roll life. From this and other experiments, the total amount of registration distribution system travel required to satisfy a desired roll life was determined. For example, it was determined that 12,600 edges per mm produces the targeted 5.0 ggu differential gloss level. Thus, in an exemplary embodiment of this invention, a target roll life of 425,000 prints, using approximately 34 mm of travel over the surface of the roll will result in an acceptance level of 5.0 ggu. In this embodiment, the 425,000 print are assumed to be uniform distributed, or zero fuser roll backlash, and does not take into account any edge smoothing at the ends of travel. Reduction in fuser roll backlash and edge smoothing will be discussed later.

Figure 4:
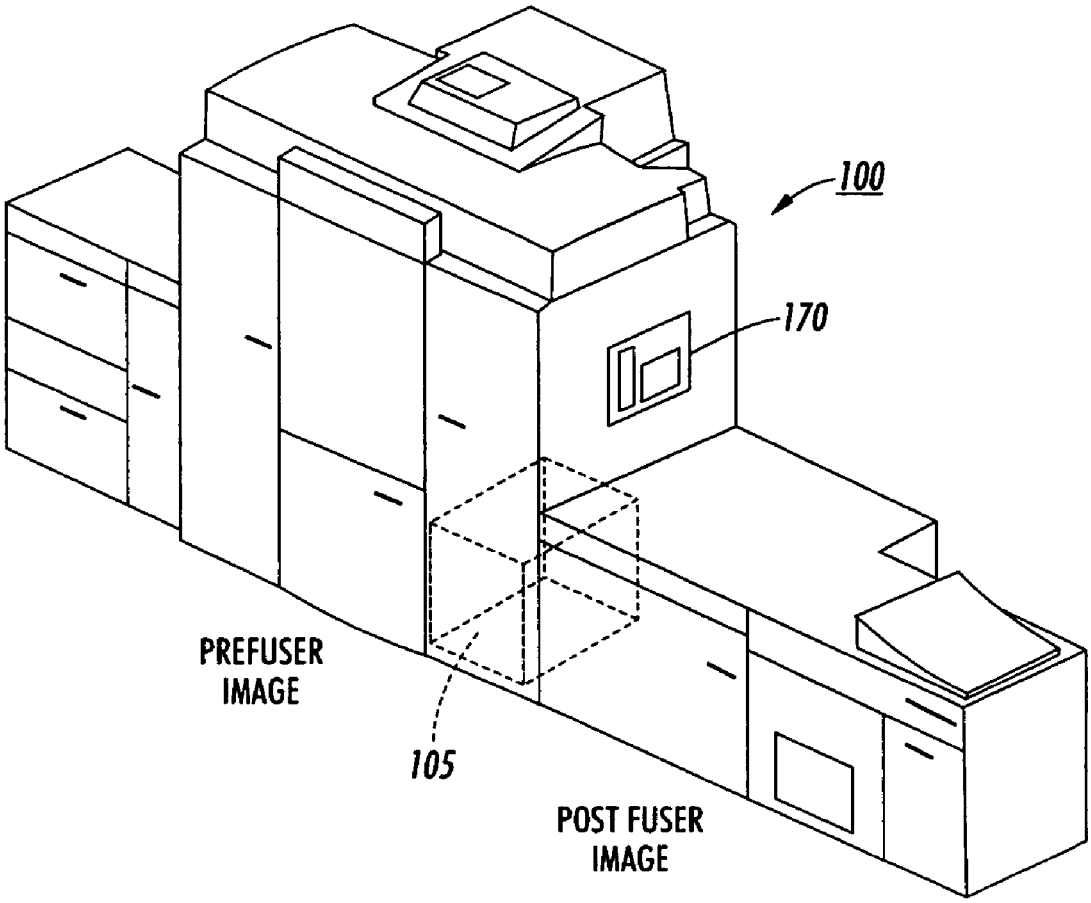
FIG. 4 shows an automated printing system.

FIG. 4 shows an automated marking system 100 for imparting marked images onto a substrate, such as a paper sheet. The automated marking system 100 includes a marking engine 105 disposed within the marking system 100. In an exemplary embodiment of the invention, the marking engine 105 includes those components found in traditional electrostatic marking devices, such as a raster image scanner, photoconductive belt, charging station, corona generator, exposure station, development station, and the like (not shown). As a sheet passes through the marking engine 105 the sheet is passed through a nip between a fuser roll and a pressure roll and a toner image is fixed to the sheet.

Figure 5:
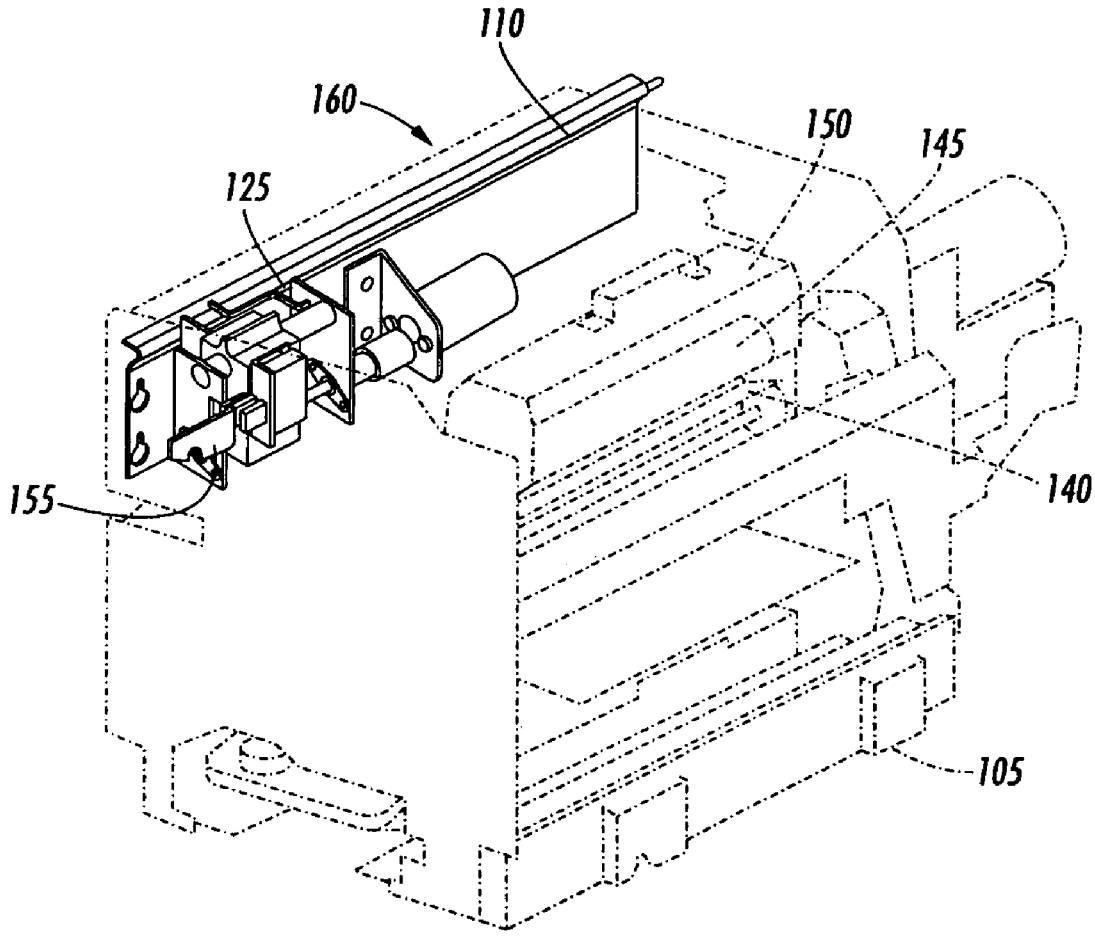
FIG. 5 shows a perspective view of a print engine removed from the automated printing system.

FIG. 5 shows a perspective view of the marking engine 105 removed from the automated marking system 100. As shown in FIG. 5, a removable roll drawer 150 is disposed in the marking engine 105. The roll drawer 150 holds a pressure roll 140 and a fuser roll 145. The roll drawer 150 is removable from the marking engine 105 to allow for roll replacement and servicing of the marking engine 105. A nip is formed between the pressure roll 140 and the fuser roll 145 to affix a toner image to a sheet. The roll drawer 150 is attachable to a Registration Distribution Sensor (RDS) plate assembly 110 via the latch 155. When the roll drawer 150 is attached to the RDS plate assembly 110 via a latch 155, the roll drawer 150 is laterally moveable. When the roll drawer 150 containing the rollers 140, 145 is connected to the fuser translation block 125 via the latch 155, the entire movable assembly is referred to as a fuser assembly 160.

Figure 6:
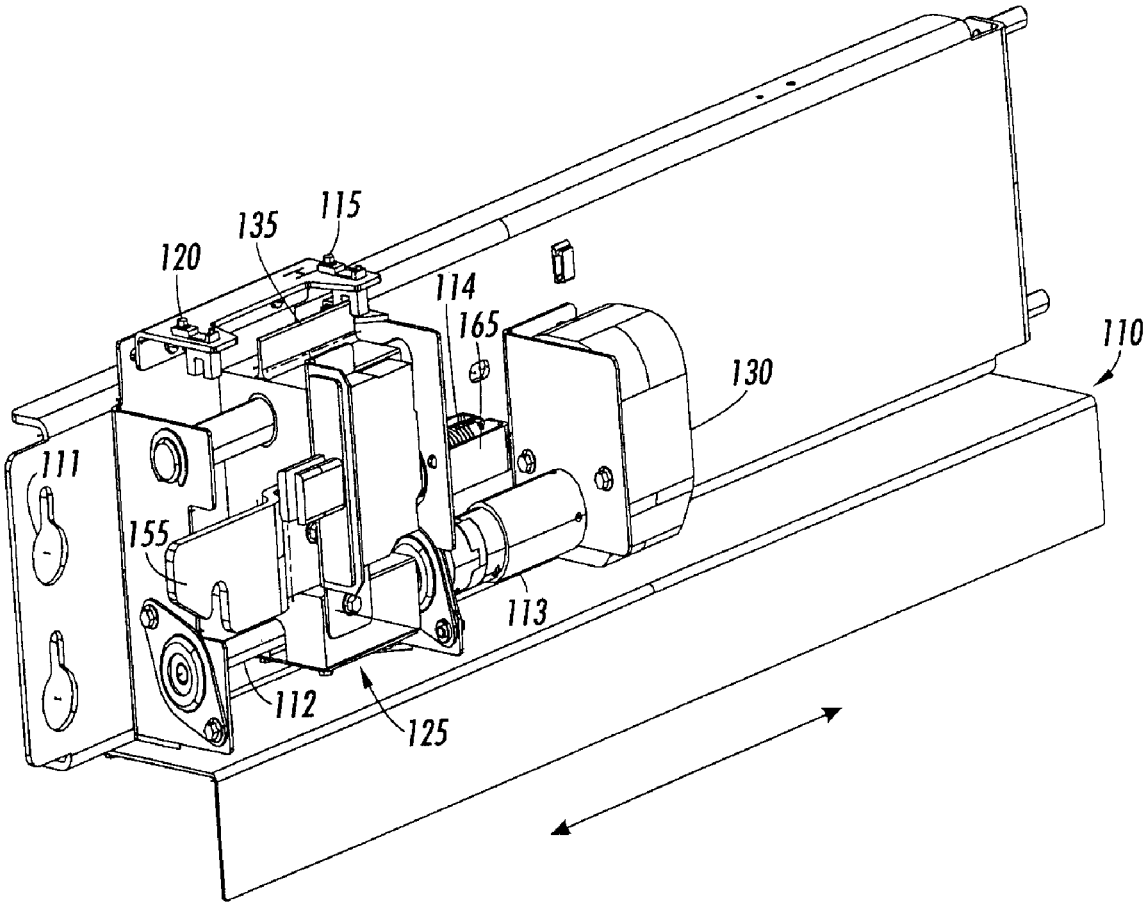
FIG. 6 shows a schematic view of a partial fuser assembly according to an exemplary embodiment of the invention.

FIG. 6 shows a schematic view of the RDS plate assembly 110. As shown in the exemplary embodiment of FIG. 6, the RDS plate assembly 110 is attachable to the marking engine 105 by screws (not shown) through screw holes 111. The RDS plate assembly 110 provides a mounting point for an RDS home sensor 115 and an RDS position sensor 120. The RDS sensors 115 and 120 monitor the movement of the fuser assembly 160 (described below). The sensors 115 and 120 are positioned on the RDS plate assembly 110 to detect positions of maximum travel of the fuser assembly 160. The fuser translation block 125 includes the latch 155 attached at one side and extending in a direction parallel to the direction of movement of the fuser assembly 160.

In an exemplary embodiment of the invention, when the roll drawer 150 is inserted into the marking engine 105, the latch 155 latches to the roll drawer 150 thereby connecting the roll drawer 150 to the fuser translation block 125. A reversible RDS drive motor 130 drives the fuser translation block 125 via a lead screw 112 through a slip clutch coupling 113 back and forth in a lateral direction, indicated by the direction of the arrow in FIG. 6. When either sensor 115, 120 is blocked by a flag 135 attached to the fuser translation block 125, the drive motor 130 is stopped, thereby halting travel of the fuser translation block 125, and therefore the fuser assembly 160, in that direction. Motion is then reversed by inverting the polarity in the drive motor 130 and the drive motor 130 drives the fuser translation block 125 in the opposite direction until the other of the sensors 115, 120 is blocked by the flag 135.

As shown in FIG. 6, the drive motor 130 rotates the lead screw 112 through the slip clutch coupling 113 to produce smooth linear motion of the fuser translation block 125 relative to the latch 155, moving the entire fuser assembly 160 back and forth very slowly. In an exemplary embodiment of the invention, the fuser assembly 160 travels approximately 0.0011 mm per sheet fused.

In an exemplary embodiment of the invention, each of the sensors 115, 120 communicate with a smart controller 170 (FIG. 4) that controls the amount movement of the fuser assembly 160. For example, when the latch 155 reaches either determined first or second maximum travel position (see FIGS. 7*a* and 7*b*), movement of the fuser assembly 160 is stopped, the polarity of the drive motor 130 is inverted, and fuser assembly 160 travel begins in the opposite direction. In the event a determined time has lapsed and the fuser assembly 160 has not reached a determined maximum travel position, then the smart controller 170 sets a fault alert to notify an operator of a potential problem.

In one exemplary embodiment of the invention, the fuser assembly 160 travels about 1.133 mm/min or 0.00074 in/sec. At this speed, the motion of the fuser assembly 160 is so slow that the sheet is transported continuously through the nip without stopping lateral movement of the fuser assembly 160.

Figure 7A:
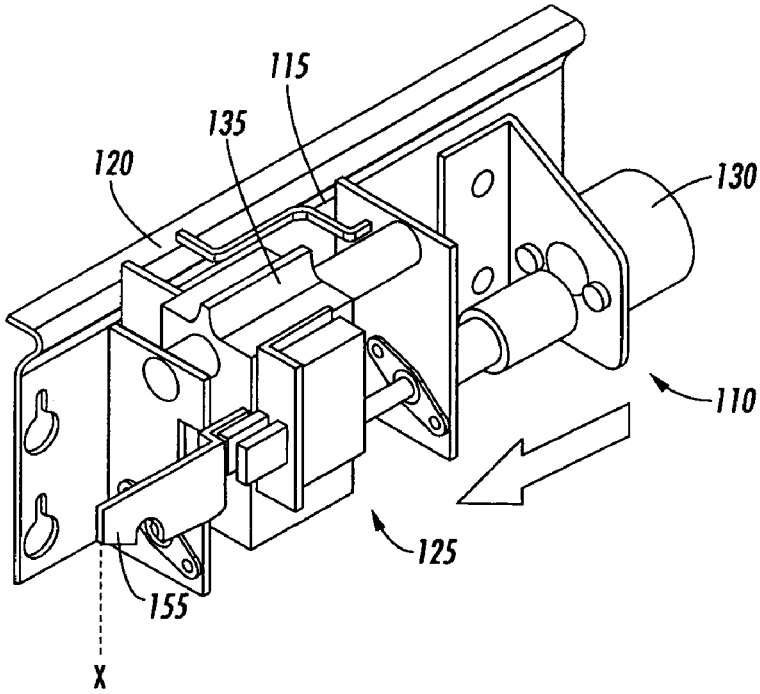
FIG. 7*a* shows a partial fuser assembly of the embodiment of FIG. 6 in a maximum travel position in a first direction.

FIG. 7*a* shows the fuser assembly 160 without the roll drawer 150 attached to the RDS plate assembly 110 to better illustrate the position of the latch 155 and the fuser translation block 125. In a maximum travel position in a first direction, indicated by the line marked X, the RDS position sensor 120 would be blocked by the flag 135 signifying the end of fuser assembly 160 travel in that direction. When the RDS position sensor 120 is tripped by the flag 135 to indicate end of travel fuser assembly travel is stopped, the polarity of the drive motor 130 is inverted, movement is reversed and fuser assembly 160 travel begins in the opposite direction.

Figure 7B:
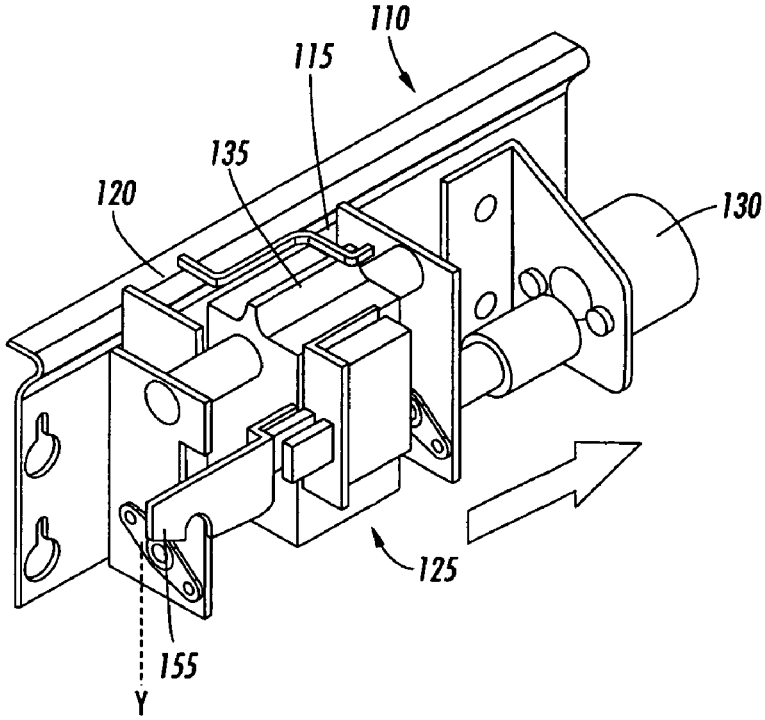
FIG. 7*b* shows a partial fuser assembly of the embodiment of FIG. 6 in a maximum travel position in a second direction.

FIG. 7*b* shows the fuser assembly 160 without the roll drawer 150 attached to the RDS plate assembly 110 to better illustrate the position of the latch 155 and the fuser translation block 125. In a maximum travel position in a second direction, indicated by the line marked Y, the RDS position sensor 120 would be blocked by the flag 135 signifying the end of fuser assembly 160 travel in that direction. Because the RDS position sensor 120 is tripped by the flag 135 to indicate end of travel, travel stops, the polarity of the drive motor 130 is inverted, movement is reversed and fuser assembly 160 travel begins in the opposite direction.

In one exemplary embodiment of the invention, the registration distribution system changes the position of the fuser roll 145 by moving the entire fuser assembly 160 over an approximately 34 mm length, represented by the distance between line X and line Y in FIGS. 7*a*, 7*b*. Such movement increases the life expectancy of the fuser roll 145 by distributing wear over a greater surface area on the roll 145.

Figure 8:
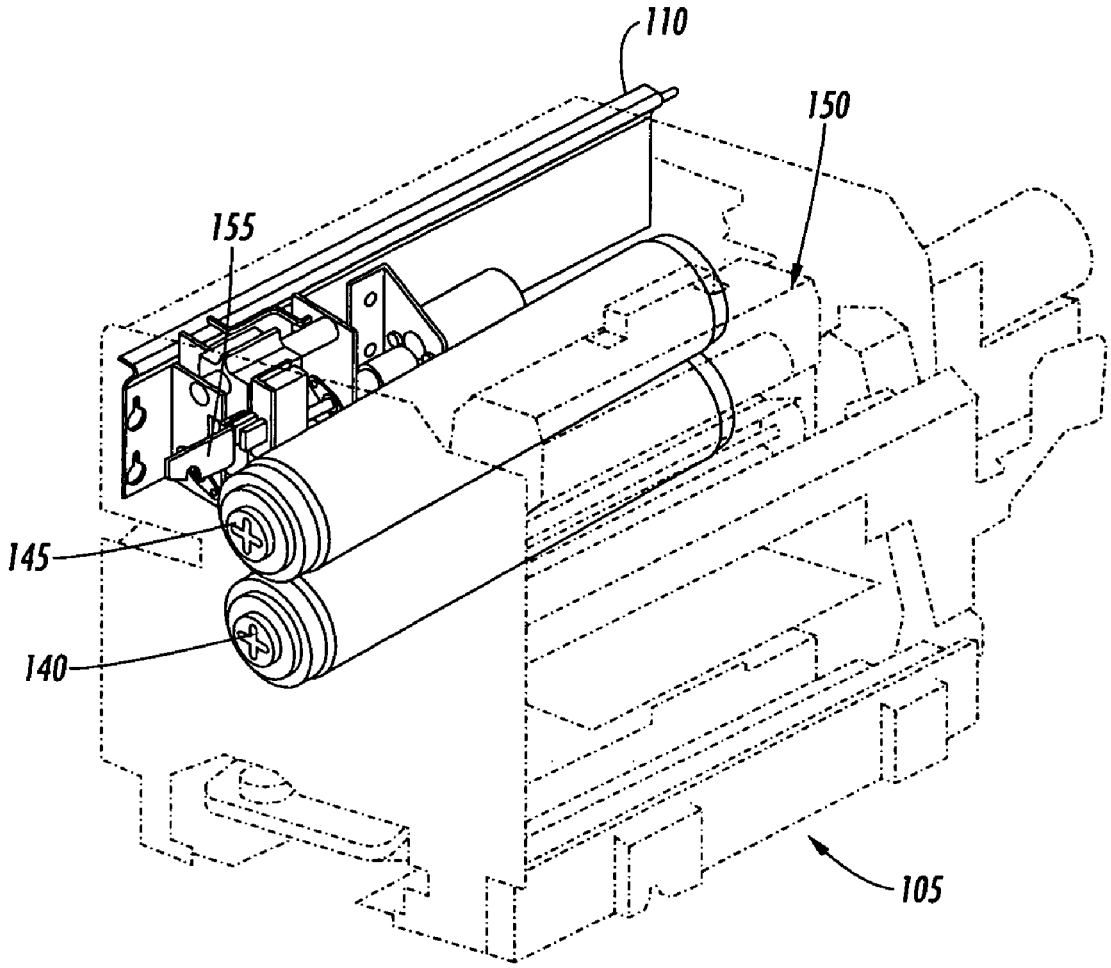
FIG. 8 shows a perspective view of a fuser assembly within a print engine.

FIG. 8 shows the RDS plate assembly 110 and the rolls 140, 145 disposed within the marking engine 105. When the rolls 140, 145 are disposed in the roll drawer 150 and the roll drawer 150 is connected to the RDS plate assembly 110 via the latch 155, the fuser assembly 160 is driven by the drive motor 130.

Figure 9:
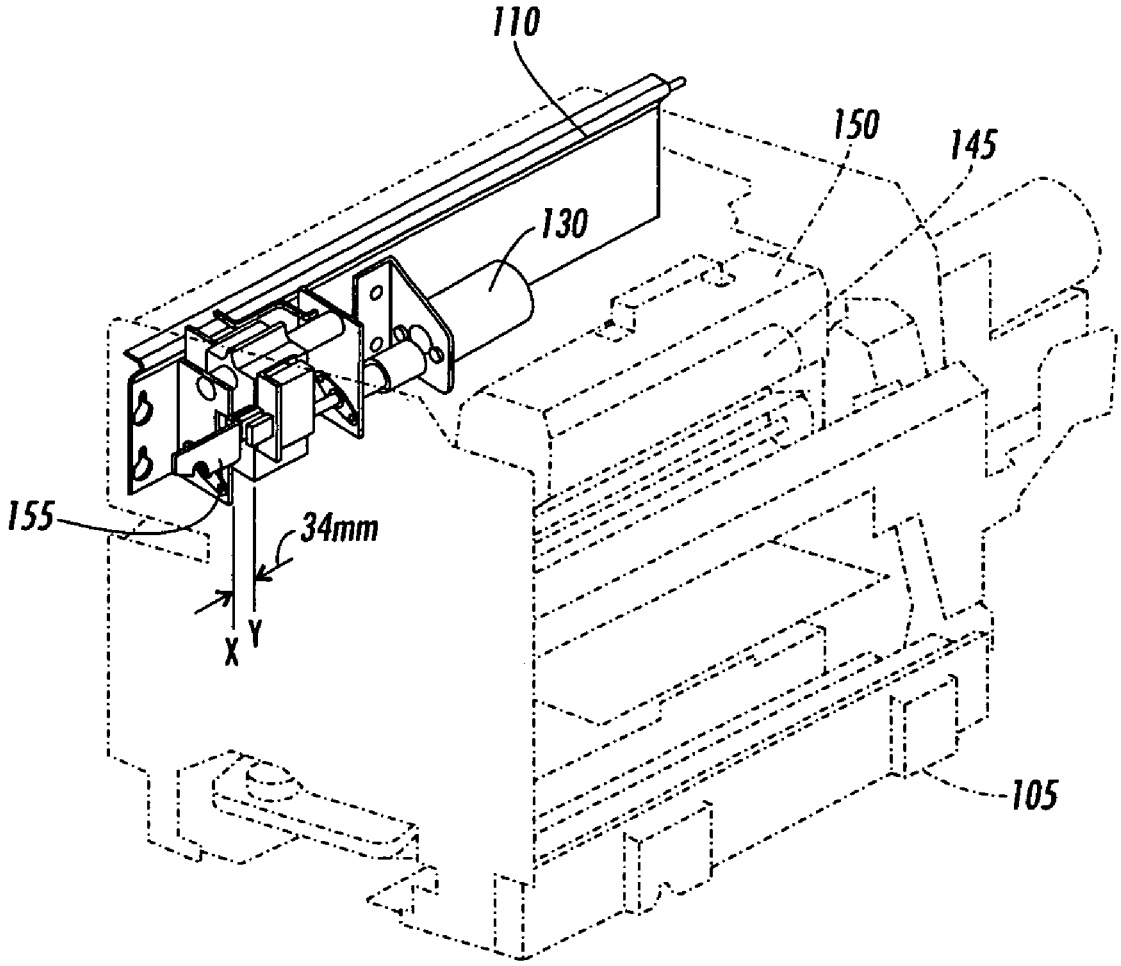
FIG. 9 shows a partial fuser assembly within the print engine disconnected from a roll drawer.

FIG. 9 shows an exemplary embodiment of the invention. In the embodiment, the roll drawer 150, including the rolls 140, 145, is installed in the marking engine 105. As shown in FIG. 9, the RDS plate assembly 110 is not connected to the drawer to better illustrate the position of the latch 155 and the fuser translation block 125. In an exemplary embodiment of the invention, the registration distribution system changes the position of the fuser roll 145 by moving the entire fuser assembly 160 over an approximately 34 mm length, shown by the distance between lines X and Y.

Although the exemplary embodiment is described using a 34 mm distance to move the fuser assembly 160, other distances are contemplated by this invention. Additionally, the distance a fuser assembly may travel for a given registration distribution system may change according to roll length, substrate width, and the like.

As described above, when the fuser assembly 160 reaches a maximum travel position, i.e., either the first or the second maximum travel direction, the drive motor 130 stops and reverses direction. During the stopping and reversing, an amount of backlash is possible. Backlash in the drive system and latch assembly results in loss of motion of the fuser assembly 160 at the ends of travel, thereby allowing extra sheets to pass over the same section of roll surface before motion in the opposite direction is resumed.

Figure 10:
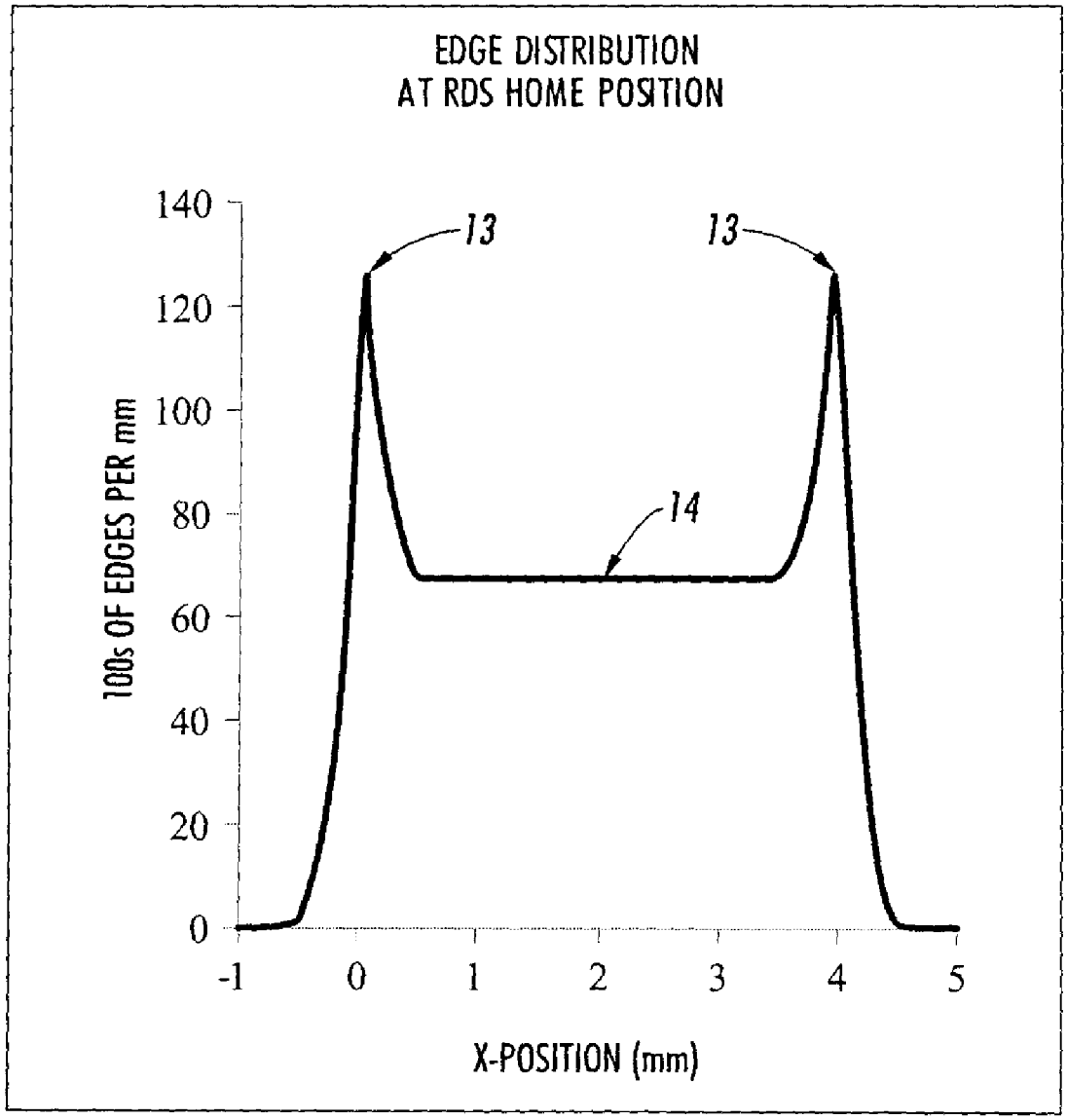
FIG. 10 is a graph showing the effects of backlash on the conformable fuser roll wear distribution of edge wear over the total travel range of a fuser assembly according to an exemplary embodiment of the invention.

FIG. 10 shows how backlash of lead screw 112 (shown in FIG. 6) may effect the distribution of edges over the total travel range of the fuser assembly 160. As shown in FIG. 10, ends of fuser assembly travel 13 reach the determined 5.0 ggu failure threshold of 12.6 k edges/mm long before the normal wear portion of the travel (14). For example, on a 34 mm travel system with 1.0 mm of backlash reaches the 5.0 ggu failure threshold in 142 k prints rather than 407 k prints for the same system with only 0.1 mm of backlash.

To reduce edge effects due to the stopping and reversing of the drive motor 130 and the fuser assembly 160, a system of backlash reduction is provided in the invention. To reduce the demonstrated affects of backlash the fuser assembly 160 is tensioned by a backlash spring 114 (FIG. 6) to reduce potential slop in the lead screw 112 and accompanying follower mechanisms. Total fuser assembly travel is set at 34 mm, an amount determined to yield the desired roll life of 425 k prints. The backlash spring 114 is attached to a bracket 165 that is mounted to the fuser translation block 125. The fuser translation block 125 is secured to the RDS plate assembly 110 thereby providing a fixed position at one end of the backlash spring 114. The other end of the backlash spring 114 is attached to the moveable fuser translation block 125 to tension the fuser translation block 125 against one side of the lead screw 112 threads, thereby reducing most or all of the play or slop in the lead screw 112 and reducing backlash.

To further reduce the impact of edge effects, it was determined that if the edge between a moderately worn area and a non-worn area is masked, the difference in gloss in the two adjacent areas is not readily noticeable. Thus, if the transition between edge accumulation areas and non-edge accumulation areas is smoothed, the gloss reduction in the worn area will go unnoticed longer, extending the effective life of the fuser roll 145 in the sense that conformable fuser roll wear will not be as readily apparent to a marking engine fuser.

Figure 11:
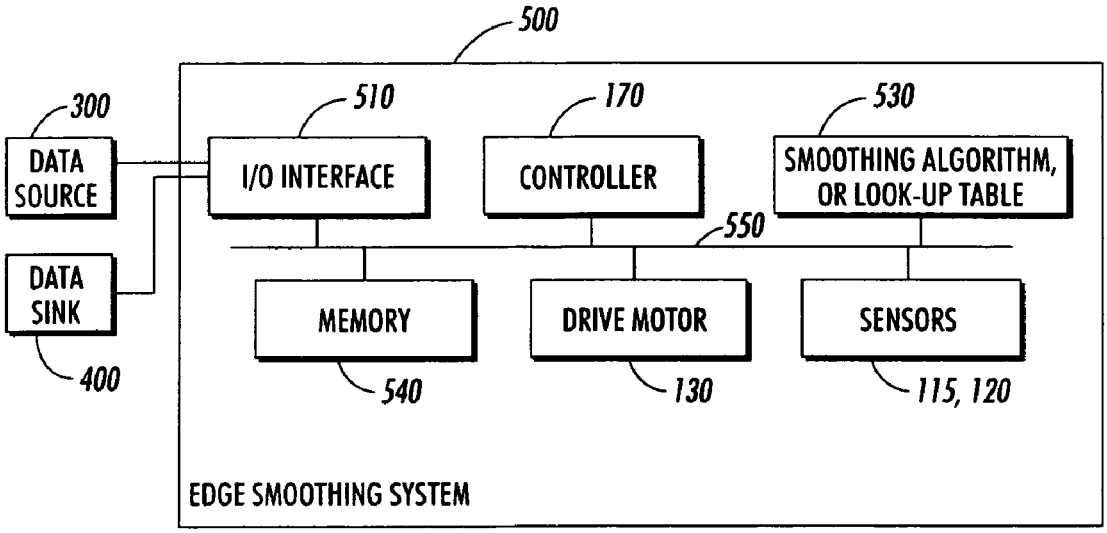
FIG. 11 shows a schematic view of an edge smoothing system according to an exemplary embodiment of the invention.

In one exemplary embodiment of the invention, to smooth the transition from the worn area within the 34 mm zone to the unworn area outside the zone, an edge smoothing system 500 is employed (FIG. 11). In the edge smoothing system 500 a smoothing algorithm is employed at the end of fuser assembly travel. Essentially, when either travel sensor 115 or 120 is actuated by the flag 135, the drive motor 130 continues to drive the fuser assembly 160 for a variable period of time, equating to a determined distance, before reversing direction, such that a desired edge distribution profile is achieved.

As shown in FIG. 11, a data source 300 is connected over a link to an input/output interface 510. A data sink 400 is also connected to the input/output interface 510 through a link.

Each of the links can be implemented using any known or later developed device or system for connecting the data source 300 and the data sink 400, respectively, to the edge smoothing system 500, including a direct cable connection, a connection over a wide area network or a local area network, a connection over an intranet, a connection over the Internet, or a connection over any other distributed processing network or system. In general, each of the links can be any known or later developed connection system or structure usable to connect the data source 300 and the data sink 400, respectively, to the edge smoothing system 500.

Although the exemplary embodiment is described using a separate data source 300 and data sink 400, it should be appreciated that the data source and data sink may be implemented in a single unit, such as the automated printing system 100.

The input/output interface 510 inputs data from the data source 300 and outputs data to the data sink 400 via the link. The input/output interface 510 also provides the received data to one or more of a controller 170, the memory 540, and a smoothing algorithm or look-up table 530. The input/output interface 510 receives data from one or more of the controller 170, the memory 540, and/or the smoothing algorithm or look-up table 530.

The smoothing algorithm or look-up table 530 provides instructions to the controller 170 based on data, such as shown in FIG. 11, that smoothes the wear profile of a conformable roller. The controller 170 controls the drive motor 130 to continue movement of the fuser assembly 160 a determined distance beyond the detected position of maximum travel according to the instruction sent to the controller 170 by the smoothing algorithm or look-up table 530.

The smoothing algorithm or look-up table 530 may be implemented as a circuit or routine of a suitably programmed general purpose computer. Such circuits or routines may also be implemented as physically distinct hardware circuits within an ASIC, or using a FPGA, a PDL, a PLA or a PAL, or using discrete logic elements or discrete circuit elements. The particular form each such circuit or routine will take is a design choice and will be obvious and predicable to those skilled in the art.

The memory 540 stores data received from the smoothing algorithm or look-up table 530, the controller 170, and/or the input/output interface 510. The memory 540 can also store one or more control routines used by the controller 170 to operate the drive motor 130 to move the fuser assembly 160 a determined amount according to the smoothing algorithm or look-up table 530 upon receipt of a signal from the sensors 115, 120.

The memory 540 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-writeable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

In one exemplary embodiment of the edge smoothing system 500 according to the invention, a sensor 115, 120 is placed approximately 2 mm from each travel limit position. Each time a sensor 115, 120 is tripped by the flag 135, a signal is sent to the input/output interface 510. The signal is also sent to the memory 540 and the smoothing algorithm or look-up table 530 via the bus 550. The instructions for moving the fuser assembly 160 a determined amount are sent from the smoothing algorithm or look-up table 530 to the motor 130. The motor 130 would continue to drive the fuser assembly 160 for a determined time period, i.e., distance. Different delay times may be derived through the smoothing algorithm or look-up table 530 so that the distribution desired was attained.

Although this exemplary embodiment is described with sensors 115, 120, it should be appreciated that other means of tripping the flag 135 may be used. For example, a mechanical limit switch is contemplated.

Figure 12:
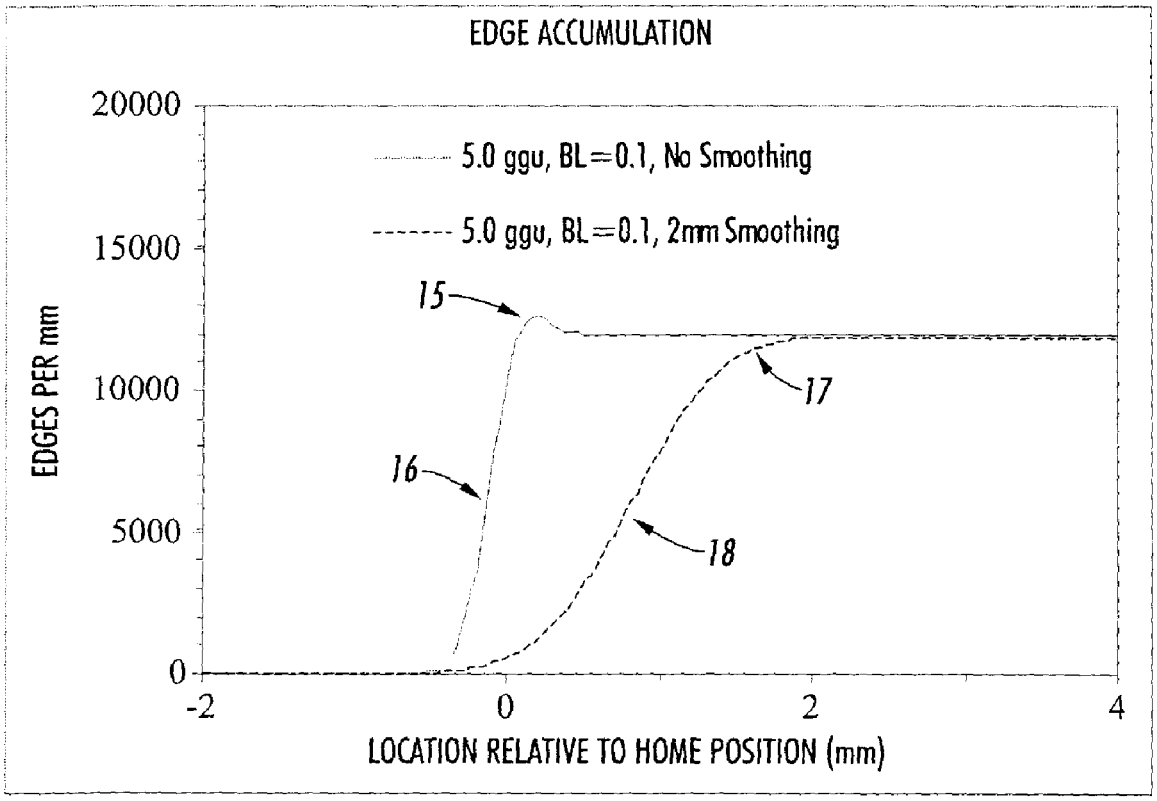
FIG. 12 is a graph showing a conformable fuser roll wear distribution comparison resulting from an exemplary embodiment of the invention using 2 mm smoothing compared with a non-smoothed case with equivalent backlash and failure levels.

FIG. 12 shows an exemplary case using 2 mm smoothing compared with a non-smoothed case with equivalent backlash and failure levels. The non-smoothed distribution, shown by the dashed line, shows a sharp wear transition 16 and a small backlash effect 15. By starting a smoothing profile, shown by the solid line, 2 mm inside of the travel limit 17, a more gradual wear transition can be attained 18.

Although this exemplary embodiment is described using a 2 mm smoothing, other smoothing distances, such as 4 mm and 6 mm, for example, are contemplated by this invention.

While the invention has been described in conjunction with exemplary embodiments, these embodiments should be viewed as illustrative, not limiting. Various modifications, substitutes, or the like are possible within the spirit and scope of the invention.

The invention claimed is:

1. A reprographic marking device that marks a substrate, comprising:

a first roll;

a second roll in press contact with the first roll to form a nip portion to move the substrate; and a drive motor for moving at least one of the first roll and the second roll in a continuous back and forth lateral motion to change a position of the at least one of the first roll and the second roll relative to the substrate while the substrate passes through the nip portion.

2. The device as in claim 1, further comprising at least one sensor to detect a position predetermined travel of the at least one of the first roll and the second roll.

3. The device as in claim 2, further comprising a flag assembly for triggering the at least one sensor, wherein the flag assembly moves concurrently with the at least one of the first roll and the second roll.

4. The device as in claim 3, wherein the drive motor reverses a direction of travel of the at least one of the first roll and the second roll when the at least one sensor detects the position of predetermined travel of the at least one of the first roll and the second roll.

5. The device as in claim 3, wherein the flag assembly triggers the at least one sensor when the at least one of the first roll and the second roll is in the position predetermined travel.

6. The device as in claim 2, wherein the at least one sensor is attached to the marking device.

7. The device as in claim 1, wherein the first roll and the second roll are housed in an openable roll drawer disposed in the marking device.

8. The device as in claim 7, wherein the drive motor drives the roll drawer in a continuous back and forth lateral motion to change a position of the first roll and the second roll relative to a substrate passing through the nip portion.

9. The device as in claim 7, wherein the roll drawer is detachably attached to a flag assembly that moves concurrently with the roll drawer.

10. The device as in claim 1, wherein the at least one of the first roll and the second roll moves about 34 mm in one direction.

11. The device as in claim 1, wherein at least one of the first roll and the second roll travels laterally about 0.0113 mm per a substrate passing through the nip portion.

12. The device as in claim 1, wherein at least one of the first roll and the second roll travels laterally about 1.133 mm per minute.

13. A method of reducing edge effects in a reprographic fusing device having a conformable surface, comprising:

moving a substrate through a nip formed between a fuser roll and a pressure roll; and continuously moving at least one of the fuser roll and the pressure roll in a continuous lateral back and forth motion relative to the direction of a substrate while the substrate passes through the nip.

14. The method of claim 13, wherein the at least one of the fuser roll and the pressure roll is moved about 0.0113 mm per each substrate passing through the nip.

15. The method of claim 13, wherein the at least one of the fuser roll and the pressure roll travels laterally about 1.133 mm per minute.

16. The method of claim 13, further comprising tensioning the at least one of the fuser roll and the pressure roll to reduce any backlash effects during the back and forth motion.

17. The method of claim 13, wherein the conformable surface has edge accumulator areas and non-edge accumulation areas further comprising smoothing a transition area between edge accumulation areas and non-edge accumulation areas to reduce differential gloss.

18. The method of claim 13, wherein at least one of the fuser roll and the pressure roll is continuously moved for a variable period of time after the at least one of the fuser roll and the pressure roll has reached a detected position of maximum travel.

19. The method of claim 18, wherein the variable period of time is determined by accessing at least one of a look-up table and a smoothing algorithm.

* * * * *